United States Patent [19]

Poore

[11] 4,254,871

[45] Mar. 10, 1981

[54] PACKAGING ELEMENT

[75] Inventor: Albert C. G. Poore, New Malden, England

[73] Assignee: Sterling Drug Inc., New York, N.Y.

[21] Appl. No.: 43,095

[22] Filed: May 29, 1979

[30] Foreign Application Priority Data

May 30, 1978 [GB] United Kingdom ..... 24381/78

[51] Int. Cl.[3] ..... B65D 83/04; B65D 85/56

[52] U.S. Cl. ..... 206/534; 206/459; 206/820; 116/308

[58] Field of Search ..... 206/534, 531, 459, 820; 116/121

[56] References Cited

U.S. PATENT DOCUMENTS

| | | | |
|---|---|---|---|
| 3,324,995 | 6/1967 | Sharp, Jr. | 206/534 |
| 3,397,671 | 8/1968 | Hartman, Jr. et al. | 206/534 |
| 3,856,144 | 12/1974 | Kelly | 206/531 |

*Primary Examiner*—William T. Dixson, Jr.
*Attorney, Agent, or Firm*—Wenderoth, Lind & Ponack

[57] ABSTRACT

A packaging element is provided for mounting blister strips containing a course of medication for a patient. The element comprises a lamina foldable along a straight line dividing the lamina into a supporting member and backing member so that when the lamina is folded the one faces of the member lie adjacent. The element is characterized in that the supporting member is provided with a plurality of apertures for receiving the blisters of a plurality of blister strips when the blister strips are mounted on the one face of the supporting member so that the blisters project through the member and form a matrix in which the blister strips are aligned with the columns of the matrix, and the backing member is provided with a plurality of apertures arranged so that when blister strips are mounted on the supporting member and the lamina is folded the contents of the blisters may be removed through the backing member, the one faces of the members bearing a compatible pressure-sensitive adhesive capable of securing blister strips to the two members and of bonding together the one faces of the two members, the other face of the supporting member bearing or being adapted to receive in relation to each row of the matrix directions as to the day on which the contents of the blisters in the row are to be administered and further being adapted to receive directions in relation to each column of the matrix as to the time of administration of the contents of blisters in the column, the element further characterized in that it comprises one or more protective release sheets strippably adhered to the pressure-sensitive adhesive.

18 Claims, 10 Drawing Figures

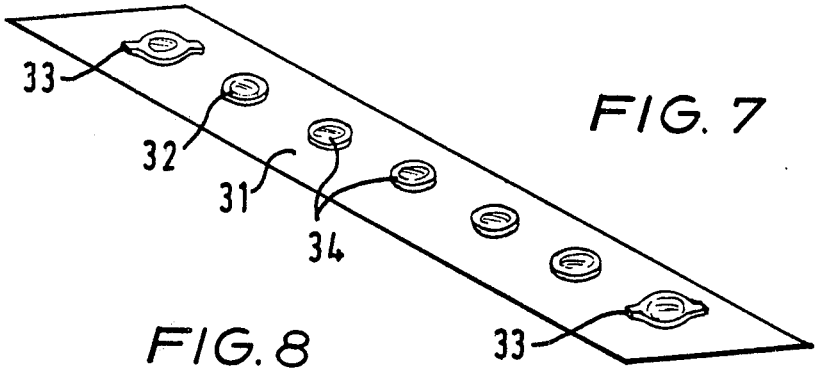
FIG. 7
FIG. 8
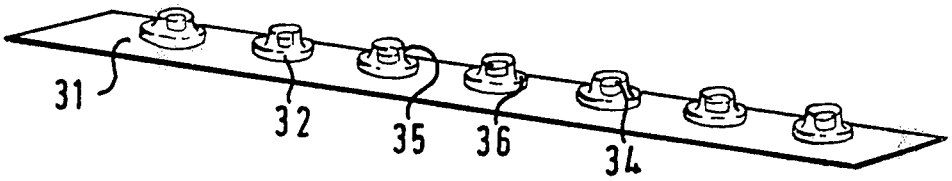
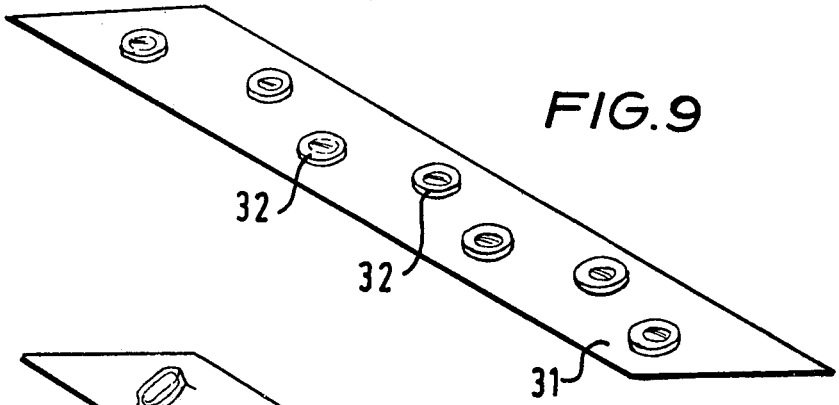
FIG. 9
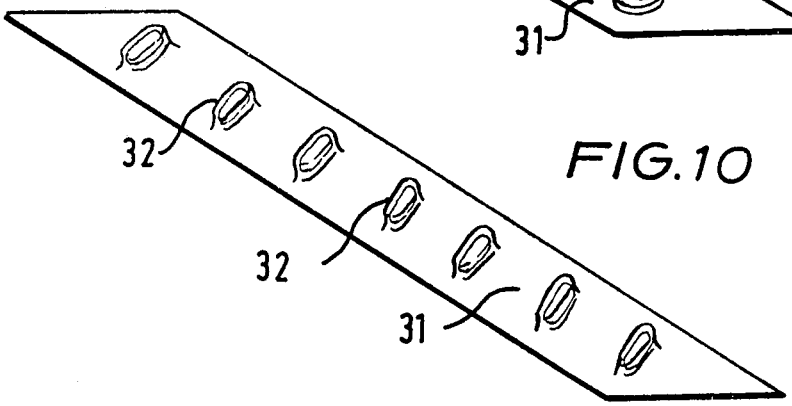
FIG. 10

PACKAGING ELEMENT

This invention relates to improvements in or relating to pharmaceutical packages, and particularly concerns the packaging of drugs to encourage patient compliance—that is to say, to encourage patients to take medication in the doses and at the times prescribed by their doctors.

Conventionally when a doctor prescribes medication for a patient the prescription is taken to a pharmacy where the appropriate quantity of medication is placed in a container on which the doctor's directions for administration are placed. All too frequently, however, the directions are abbreviated to the extent that the patient must remember the prescribed doses and times, which may only have been given verbally by the doctor.

Obviously for a prescribed treatment to be fully effective the doctor's instructions concerning the dose and frequency of administration of the medication must be followed. If the drugs are not administered at the correct times or in the correct amounts the efficacy of the prescribed treatment is reduced and serious side-effects may also result.

Non-compliance with the instructions frequently occurs, even when these are clearly displayed on the container, as a result of the patient either deliberately or, more usually, inadvertently failing to take the appropriate dose at the appropriate time. Forgetful patients are obviously most likely to fail to comply with directions, and the problem is particularly acute with geriatric patients who tend to be more forgetful and are often prescribed several different drugs to be taken at different frequencies and in different amounts.

This invention seeks to provide a means of packaging blister strips enclosing a course of medication so as to encourage the patient to follow the doctor's instructions for the administration, while at the same time giving an indication whether the treatment is being followed. Blister packs or strips are a well-known form of container for pharmaceutical preparations and they generally comprise a lamina having formed therein one or more blisters or pockets, the openings of which are closed by a frangible membrane. A pharmaceutical preparation such as a tablet may be placed in a blister before the membrane is applied to seal the contents within the blister. To remove the tablet the blister is distorted so that the tablet breaks the membrane and emerges through the broken membrane. Usually the lamina is made of a transparent plastics material so that the contents of the blisters are visible, but the lamina may also be opaque and this may be desirable where it is desired to make the blisters more child-resistant. The frangible membrane is normally a metal foil, and is most commonly a high-tempered thin-gauge aluminium foil. Blister packs may be formed in a variety of configurations and packs comprising a plurality of blisters arranged linearly are usually termed "blister strips".

It is usual to employ blister packs as containers for solid pharmaceutical preparations such as tablets or pills, and the invention is described with particular reference to such forms. It is to be understood that blister packs, and thus blister strips used in the present invention, may also be used as containers for other solid and semi-solid products such as lozenges or cachets, and even gelatin capsules. Equally, blister packs are used as containers for a wide variety of non-pharmaceutical products and the packaging techniques described in relation to the invention may be used to mount blister strips containing such products.

In one aspect this invention provides a packaging element for mounting blister strips containing a course of medication for a patient, which element comprises a lamina foldable along a straight line dividing the lamina into a supporting member and a backing member so that when the lamina is folded the one faces of the members lie adjacent, the supporting member being provided with a plurality of apertures for receiving the blisters of a plurality of blister strips when the blister strips are mounted on the one face of the supporting member so that the blisters project through the member and form a matrix in which the blister strips are aligned with the columns of the matrix, and the backing member being provided with a plurality of apertures arranged so that when blister strips are mounted on the supporting member and the lamina is folded the contents of the blisters may be removed through the backing member, the one faces of the members bearing a compatible pressure-sensitive adhesive capable of securing blister strips to the two members and of bonding together the one faces of the two members, the other face of the supporting member bearing or being adapted to receive in relation to each row of the matrix directions as to the day on which the contents of the blisters in the row are to be administered and further being adapted to receive directions in relation to each column of the matrix as to the time of administration of the contents of blisters in the column, the element further comprising one or more protective release sheets strippably adhered to the pressure-sensitive adhesive, so that in use the or each release sheet is removed from the lamina, blister strips containing a course of medication are mounted on the supporting member and the backing member is bonded to the supporting member by folding the lamina to form an integral package to which appropriate administration directions are applied, and from which the contents of the blisters may be removed without disturbing the integrity of the package.

The packaging element is intended as a storable item that may be held in stock by pharmacists, so that when this form of presentation is required for medication it may be used to assemble a package with blister strips containing the prescribed medication for the patient. In the assembled package the blisters containing the course of medication are sandwiched between the two members to form a matrix in which the medication for a day of the week occupies its own row, and each column corresponds to a time of day for administration.

It is particularly preferred that the packaging element of the invention is adapted to be capable of mounting a one week course of medication for a patient. This may be achieved by providing the supporting member with apertures capable of receiving blister strips with their blisters in the form of a seven row matrix, and by providing the backing member with appropriate apertures to allow the contents of blisters so mounted to be removed. In this arrangement for each day of the week there is a corresponding row in the matrix.

In this preferred embodiment the supporting member is capable of mounting blister strips so that the blisters form a full seven row matrix for maximum adaptability, but it is to be understood that in use the prescribed treatment may not extend over the whole week and in that case not all of the apertures will be occupied by a blister and the matrix in the assembled package will be incomplete. Furthermore, even where the treatment extends over a full week, the doctor may wish the treatment to change during that week, in which case one or more of the columns of the matrix may be formed by the blisters of two (or, if two changes in medication are required, more than two) blister strips mounted end-to-end on the packaging element. Thus, the preferred packaging element of the invention may be employed with blister strips comprising from 1 to 7 blisters. It is envisaged that the preferred packaging element will, however, most usually employ septuple blister strips—that is to say, blister strips having a linear arrangement of seven blisters—and the contents of each septuple blister strip then represent the dose to be taken at a particular time of day for each day in the week.

The lamina used in the element is conveniently adapted to be readily foldable along the line dividing it into the two members so that the folding operation may be performed quickly and without the remainder of the lamina being distorted. Thus, the lamina is preferably provided with a scored or weakened portion along the line of the fold. It has been found most convenient if the lamina is provided with two closely-spaced creased lines along the line of the fold, as this facilitates the accommodation of blister strips between the two members when the lamina is folded.

The lamina may be any shape which when folded will give the package an easily manipulable configuration. It is preferably symmetrical about the fold line so that the outer edges of the two members correspond when the lamina is folded. This gives the formed package additional strength. Preferably the lamina is rectangular with the fold line parallel to and equidistant between two opposed sides of the rectangle.

The lamina is preferably made from a material of sufficient strength to give the whole package a substantially rigid generally planar configuration when unsupported. From the point of view of economy it is greatly preferred that the lamina be a suitably shaped cardboard sheet. When cardboard is employed this is very desirably of single-ply construction, and not a laminated board. It is believed that uncoated white sulphite or white manilla board is particularly suitable for use in the invention, although the skilled man will appreciate that other types of cardboard could also be used. It is also possible to use sheets formed of plastics material, or even composite sheets formed of laminated paper and plastics materials.

When a cardboard sheet is employed this is preferably in the form of a sheet from 0.20 to 0.46 mm thick, and most preferably from 0.28 to 0.38 mm thick.

The length and width of cardboard sheet employed is dependent on the size and number of blisters to be mounted, but by way of illustration it is pointed out that excellent results may be obtained when mounting ten septuple blister strips using a rectangular lamina in which the supporting and backing members are of equal size, and in which the lamina measures 25–30 cm×33–38 cm, and particularly good results have been found with a size of 26.5 cm×35.0 cm. An effective mount for six septuple blister strips conveniently measures 15–18 cm×33–38 cm, and an especially effective lamina for this number of blister strips is dimensioned 16.0 cm×35. cm. These dimensions enable the complete package made up of the lamina and blister strips to be relatively compact and yet display surprisingly high strength enabling the contents of the blisters to be removed without the bond between the lamina and the blister strips or the adhesion between the two members of the lamina being broken.

Each of the members making up the lamina is provided with apertures so that the blister strips may be securely mounted within the package with their contents readily removable. The apertures in each member may be a series of individual holes one to each blister or may be in the form of elongate slots adapted to receive more than one blister. In some applications it may be desirable to employ a combination of holes and slots to receive the blisters. The preferred arrangement, which has been found to provide excellent support, comprises a matrix of individual holes on each member corresponding to the desired matrix of blisters. This gives a particularly good bond between the blister strips and the members with the blister strips being secured around the complete periphery of each blister.

The individual apertures may be circular, and where it is intended only to use the package in conjunction with circular blisters this is the preferred shape for the apertures. However, some pharmaceutical forms such as capsules, are elongate in shape and are conveniently packaged in elongate blisters. In a particularly preferred embodiment the apertures are shaped to receive both circular and elongate blisters for example, the apertures may be circular holes having two diametrically-projecting lobes, and thus in the form of a four-cusped ellipse, or quatrefoil, as shown in the accompanying drawings.

For some applications it may be desirable to obtain smaller overall dimensions by employing a lamina in which the apertures in each member are in the form of slots arranged to lie one along each column of the blister matrix so that each slot is capable of receiving the blisters of one blister strip, the slots being formed with necks equispaced between their ends to define within each slot the appropriate number of blister-receiving portions. This particular arrangement enables the lamina to be more compact since the spacing between the blisters on the blister strip used in the package may be reduced, and in small volume production it may also make the manufacture of the lamina a somewhat easier operation.

The apertures in the two members need not be identical provided that they coincide when the lamina is folded. In fact in many instances it may be desirable for the apertures in the backing member to be slightly larger than those in the supporting member to provide some tolerance, so that if the supporting member and backing member are not accurately aligned before being bonded together the contents of blisters sandwiched between those members may still readily be dispensed.

The size and spacing of the apertures is of course determined by the size and spacing of the blisters on the blister strips. It is not feasible to discuss all possible relations between size and spacing for all types of blister. The following data is presented to show the results of studies on the optimum size and spacing of the apertures for a blister strip that has been found to be especially suited for use as a container for a wide range of pharmaceutical products. It is believed that this data would enable a skilled worker to ascertain the optimum form of the apertures for different blister strips.

For a blister strip in which the spacing between blister centres is 20 mm and the overall blister strip size is 147 mm×20 mm, the optimum aperture configuration in each member is a matrix of holes corresponding to the desired matrix of blisters and the spacing between the centres of the holes in each column is of course 20 mm. A useful overall circular blister size is 13.5 mm diameter and the diameter of circular holes in the supporting member to receive such blisters is preferably from 14 to 17 mm, and most preferably from 15 to 16 mm. The blister size may be smaller if the contents have a smaller overall size but then the blisters are not given the same positive location in holes of the preferred size. Where it is essential that the blister should be considerably smaller than 13 mm, to ensure that the blisters are accurately positioned in the holes the blisters are preferably provided with shoulders or radial spurs to give a width measured across the extremities of the shoulders or spurs of from 12 to 14 mm and preferably 13.5 mm. Each blister in a strip may be formed with shoulders or spurs in this way, but excellent results have been obtained by only forming the terminal blisters of the strip with shoulders or spurs. Such blister strips are described in more detail hereinafter.

It is found to be convenient for capsules to be packaged in correspondingly shaped, elongate blisters. On a blister strip these elongate blisters are conveniently also spaced at 20 mm between centres, and it has been found advantageous for the long axes of the individual blisters to be angled to the long axis of the strip. Preferably the blister axis is at an angle of from 40° to 60° to the strip axis, and most preferably at an angle of from 45° to 55°. The apertures of a supporting member for mounting these blisters should be correspondingly shaped to receive the angled elongate blisters. A particular embodiment is shown in the drawings.

An alternative means of providing positive location within the apertures of the supporting members for strips having small blisters is to stagger the blisters relative to the axis of the strip. The blisters may, for example, be offset from the centreline of the strip alternately to one side and to the other, provided that the traverse distance between the extremities of blisters does not exceed the width of the aperture in which they are to be located.

The spacing between adjacent apertures in the same row when using the preferred strips described above is preferably from 22 to 24 mm between centres, and most preferably from 22.5 to 23.5 mm between centres, with a spacing of 23 mm being especially preferred.

Obviously the spacing of the apertures in the backing member must be substantially identical so that the arrays of apertures on the two members will match up. However, as indicated hereinbefore the apertures in the backing member may be somewhat larger than the corresponding apertures in the supporting member.

The one faces of both the supporting member and the backing member bear a compatible pressure-sensitive adhesive. The adhesive anchors the blister strips to the members and also bonds the two members to each other. In order to do this the adhesive must be compatible with the lamina and with the blister strips. By the term "compatible" it is meant that the pressure-sensitive adhesive is adherent to the material of the lamina and to the materials of component parts of the blister strips without there being any unwanted chemical interaction between the adhesive and these materials. Typically this imposes a triple limitation on the adhesive since the lamina, the blisters and the sealing membrane of the blister strips are usually composed of different materials with widely different tolerances of adhesives. As indicated above the lamina is preferably cardboard, and as discussed later the blister strips are preferably composed of a clear plastics material such as polyvinylchloride or polyvinylchloride coated with polyvinyldichloride and the sealing membrane is preferably aluminium foil which may carry printing and protective lacquers. Thus in a specific preferred embodiment the adhesive must be compatible with cardboard, PVC and lacquered aluminium.

The contact adhesive must also provide a bond of considerable strength, so that when the package is assembled it remains bonded as an integral package during storage and when the contents of the blisters are removed, without any break-down in the adhesion bonds between the two members and the blister strips. The effect of the blister strips sandwiched between the supporting member and the backing member is to bias these two members apart, and it has been found that this subjects the adhesive bond to a long-term low-stress force. If the adhesive is inadequate "stress lifting" will take place, the adhesive bond will break and the members will spring apart. It has now been established that the adhesive must be capable of resisting this long-term low-stress force, and thus must possess sufficient "creep resistance", which is the term given to the ability of an adhesive to resist this type of force.

To remove the contents of a blister it is usual to press the contents through the frangible member by squashing the blister, and this operation subjects the assembled package to considerable short-term local shear forces. It has been found to be essential that the adhesive is also capable of resisting these short-term forces without the bond breaking or the integrity of the package being disturbed.

An adhesive must satisfy these criteria to be "a compatible pressure-sensitive adhesive" suitable for use in the invention. In effect the adhesive must have the correct balance of tack and cohesive strength under the conditions it will meet in use, while being compatible with those substrates with which it comes into contact. Adhesives may be subjected to empirical testing in a package assembled with a packaging element and blister strips as described hereinbefore. The ability of the adhesive to satisfy the criteria required for the invention may then be evaluated by visual inspection of the package for signs of instability or incompatibility under long term and short term stress during storage and use. However, it is clearly ,esirable that some form of quantitative testing of adhesives should be available to evaluate their ability to satisfy the requirements of the invention. It is notoriously difficult to quantify the performance of adhesives on an absolute scale but we have been able to determine preferred minimum requirements for the immediate 180° peel adhesion and shear resistance of adhesives for use in the invention.

The immediate 180° peel adhesion is the force required to remove pressure-sensitive adhesive coated material immediately after it has been applied to a test plate by pulling it away from the test plate at an angle of 180° (that is, by peeling the material back along the plane of the test plate) and at a specified speed. The preferred minimum requirement for immediate 180° peel adhesion is 1000 grams/50 mm from a stainless steel test plate (having 180 grit finish) at a peeling speed of 200 mm/min., a temperature of 20° C.±2° C. and a relative humidity of 50%±2%. A test that we have found useful in establishing the value of immediate 180° peel adhesion is based upon F.I.N.A.T. Specification No. 1 published by the Federation Internationale des Fabricants et Transformatears d'Adhesifs et Thermocollants of The Hague, Netherlands, but modified in the following respects:

(a) the test is carried out immediately after applying the test strip to the test plate, and not after a 24 hour delay;

(b) a stainless steel test plate replaces a plate glass test plate;

(c) a jaw separation rate of 200 mm/min is employed; and (d) a 50 mm wide test strip was employed.

It is pointed out that an adhesion of 1000 grams/50 mm means that a force of 1000 grams was required to peel the 50 mm wide test strip of adhesive coated material from the stainless steel test plate under the specified conditions. An example of a test carried out according to this modified Specification is set out hereinafter.

The shear resistance of a pressure-sensitive adhesive is the time required for a standard area of adhesive coated material, when applied to itself, to slide apart under load. The preferred minimum requirement for shear resistance is 12 hours for 20 mm×20 mm overlap between adhesive coated samples applied face to face to slide apart under a shear load of 1000 grams. The shear resistance is conveniently measured by F.I.N.A.T. Specification No. 8 at 23° C.±2° C. and 50%±2% relative humidity. An example of a test carried out according to that Specification is set out hereinafter.

Preferably an adhesive for use in the invention satisfied both these minimum requirements as well as the requirements for compatibility set out hereinbefore and most preferably the minimum immediate 180° peel adhesion requirement should be satisfied for samples applied to test plates with each type of surface with which it will come into contact in a package assembled using the packaging element of the invention.

Furthermore, it is desirable that the adhesive does not become unstable as it ages. The packaging element of the invention may be expected to be stored for considerable periods of time before being assembled into a package, both at distributors and in pharmacies. When assembled a package will normally be used much more quickly; in the preferred embodiment where the assembled package contains a one week course of medication it is likely that a patient will not be supplied with more than a one month course in four assembled packages at any one time. The adhesive desirably must retain its properties throughout this storage and the period of use, and accordingly adhesives for use in the invention very preferably comply with the minimum requirements for immediate 180° peel adhesion and shear resistance even after 1 year storage or an equivalent period of accelerated ageing.

It has been found that the requirements for the pressure-sensitive adhesive are not met by the vast majority of adhesives tested. Moreover suitable adhesives do not fall within any single chemical class. Generally it may be said that adhesives will be selected from natural or synthetic polymer adhesives, and most usually the adhesives will be based upon a synthetic rubber base.

Certain adhesives using acrylic base polymers may be suitable for use in the invention. Most surprisingly we have found that adhesives employing a styrenebutadiene rubber as the base polymer may be particularly suitable. However, the invention is not restricted to these adhesive types, and it is possible that other adhesive systems will in the future provide adhesives capable of meeting the requirements of the invention.

It is well-known to those skilled in the adhesive art that adhesives are formulated from a variety of components. In addition to the base polymer, which generally forms a major or significant proportion of the adhesive, there will normally be incorporated tackifiers, fillers and other materials which modify the secondary properties of the adhesives, such as anti-oxidants. The choice of these additional components affects the properties of the adhesive but it is believed to be within the competence of the skilled worker to adjust these as necessary when a promising adhesive system has been identified in the manner described above.

An adhesive formulation which has been found to be outstandingly effective in the packaging element of the invention, and which is therefore presently highly preferred, is a styrene-butadiene rubber adhesive designated R&D663 RO3available from Norprint Limited of Boston, Lincolnshire, England.

The particular pressure-sensitive adhesive chosen will dictate the optimum coating weight of adhesive for satisfactory performance of the invention. However, by way of illustration it may be said that adhesive coating weights of from 10 to 30 g/sq. meter will be preferred for most applications, and most preferably the coating weight will be from 15 to 25 g/sq. meter.

In order to enable the packaging element of the invention to be stored without adhering to neighbouring articles the element also comprises one or more protective release sheets covering the adhesive. Release sheets should be firmly adherent to the adhesive so that it will not become dislodged during normal handling and yet is strippable therefrom when the packaging element is to be put into use. In a preferred embodiment the release sheet (or sheets) is also provided with apertures corresponding to those in the supporting and backing members of the lamina. The release sheet is preferably a silicone-coated release sheet, which is usually a paper sheet. It is particularly advantageous if the release sheet is either sufficiently transparent or translucent to enable instructions printed on the adhesive coated faces of the members to be read through the release sheet or is capable of carrying instructions on its own outer surface.

The adhesive may be covered by a single release sheet extending over all the adhesive-coated faces of the members of the packaging element. However, it may in some instances be advantageous for separate release sheets to be applied to the supporting member and the backing member respectively. It is convenient for ready removal of the release sheet or sheets if each sheet extends slightly beyond the adhesive-coated portions of the lamina. The unadhered portion of each release sheet may then be grasped in order to strip that sheet from the lamina.

The packaging element of the invention enables the individual doses of a course of medication to be mounted in a matrix with the medication for each day forming a row in the matrix. To encourage the patient to administer each dose on the correct day at the correct time the columns and rows of the matrix in the complete package are labelled appropriately, with one day being assigned to each row. The outer face of the supporting member may either bear this information or be adapted to receive the information so that it may be applied when the package is assembled. Since it is obviously highly advantageous for the rows to be labelled in sequence, it is preferable from the point of view of simplifying the preparation of a package if the element of the invention incorporates labelling of the rows. This may be achieved by printing the days of the week on the outer face of the supporting member. It has been found most desirable to apply the information to the supporting member so that it lies to the left of the matrix when the package is held by the patient so that the directions for administration can be read. A simple abbreviation of the name of the day of the week is sufficient, but it is highly desirable that the supporting member be marked so as to define easily discernible stripes which extend thereacross, each stripe corresponding to and being associated with the apertures for receiving the blisters of one row of the matrix. For example, the outer face of the supporting member may be given a striped appearance by applying alternating bands of contrasting colours. In this way the patient may more easily identify the row in the matrix corresponding to a particular day.

In some applications to avoid confusion it may be preferable to label the rows of the matrix so that the top row corresponds to the first day of treatment. In such cases it is more convenient to apply directions as to the day of administration to be applied to the supporting member when a package is assembled. The outer face of the supporting member should in these circumstances be adapted to receive the information. The member may, for example, be provided with a space in which the information could be written against each row or the information could be applied by a suitable rubber stamp, but it is most convenient if the supporting member is adapted to receive manually-applied labels bearing the appropriate designations. In this way the pharmacist can label the rows so that the first dose to be administered is always taken out of the top row of the matrix irrespective of when in the week the treatment starts.

The time of day when doses are to be administered may vary widely depending on the complaint being treated, the nature of the treatment and the age of the patient. Thus, to ensure the maximum adaptability for the element of the invention directions for the time of administration may be applied to the element when it is assembled into a package. The supporting member is adapted to receive such information and again, although the information could be written, stamped or printed on the member, it is preferred that these directions are also applied in the form of individual labels, so that the member is adapted to receive one such label for each column of the matrix.

It is usual for medication to be administered 3 times a day, and in some cases 4 times a day. Suitable labels could be provided marked with the time of day, but unless a 24 hour clock is used, this could cause some confusion. It has been found that the times of administration are best related to the following "events" in the day such as: BREAKFAST, NOON, TEATIME and BEDTIME and the labels are preferably marked with these times. In addition it is preferable for the labels to be coloured, with the labels for each time having a characteristic colour.

When such labels are used to apply information to the supporting member they are desirably backed with a pressure-sensitive adhesive and stored before use on a backing release sheet. The outer face of the supporting member may be provided with areas to which the labels can be attached to relate to the columns, and where appropriate the rows, of the matrix of doses. If the lamina is cardboard the outer face is preferably suitably finished to enable labels to be applied and removed or relocated, as necessary, without damage to the surface. The adhesive is preferably one which rapidly reaches its full adhesive strength after application.

In a preferred aspect the element of the invention is also adapted to receive further information such as the identity of the patient, the identity and address of the pharmacist assembling a package from the element and the date. Most conveniently the outer face of the backing member is adapted to receive this information by having delineated areas into which the information may be entered.

In use it is intended that where the prescribing doctor wishes a patient to use the packaging system of this invention he will specify its use on the patient's prescription. When the prescription is presented to the pharmacist the medication will be made up in a package using the element of the invention and the appropriate blister strips. The pharmacist takes an appropriate size of element (having sufficient apertures to accommodate all the columns of the matrix required for the course of medication), peels off the backing sheet protecting the supporting member and places it with the face bearing the adhesive uppermost. Blister strips are then arranged in an appropriate array in the apertures in the supporting member, with the strips forming the columns and the columns preferably being arranged so that the doses are in chronological order reading from left to right. To assist the pharmacist, when the element already bears the directions for the day of administration on the other (non-adhesive) face, it is desirable that the one face of the supporting member has a corresponding set of directions and as indicated hereinbefore these directions may be provided on a release sheet.

When the blister strips are mounted on the supporting member pressure is applied to bond them to that member; if the lamina still bears other release sheets these are then removed before the lamina is folded to bring the adhesive-bearing faces of the backing member and the supporting member and the mounted blister strips into contact so as to sandwich the blister strips between the two members. Pressure may be applied as necessary to ensure that the two members are bonded together, and that the package is integrated. The package may then be turned over to place the supporting member uppermost and the appropriate directions applied to the outer face of the supporting member. The complete package is then ready to give to the patient.

The assembly described above is greatly facilitated if it is carried out on a platform on which the supporting member of the lamina may be located, the platform comprising a bearing surface provided with a plurality of sockets corresponding to the apertures in that member. While the bearing surface may be provided with a matrix of recesses, with one recess corresponding to each aperture in the supporting member, it is preferred for the bearing surface to be provided with a number of elongate slots, with each slot corresponding to a row of apertures in the matrix. When the supporting member is located on the platform with its outer face in contact with the bearing surface and the apertures in that member aligned with the sockets, blister strips may be mounted on the supporting member with the blisters projecting through the member and into the sockets. The platform enables the blister strips to be quickly and firmly mounted in position and also supports the element as it is folded around the blister strips and bonded to itself to form a package.

For use in conjunction with the preferred form of packaging elements described herein the platform preferably comprises a bearing surface having seven slots corresponding to the seven rows of the matrix of blisters. Obviously the length of the slots may be chosen to accommodate the size of packaging element with which it is to be used. By way of illustration it has been found advantageous for the bearing surface and slots to be large enough to support two adjacent packaging elements capable of mounting ten columns and six columns of blisters respectively.

The bearing surface is preferably rectangular in outline, and most conveniently the long edges of the surface are bounded by upstanding walls so that a rectangular supporting member of the appropriate size is held in position on the platform by the walls.

The platform may also be provided with a second bearing surface adapted to support the backing member when the supporting member is located on the first bearing surface. This second bearing surface preferably lies at an obtuse angle to the first surface, and desirably is rectangular and of substantially similar dimensions to the first bearing surface, being joined thereto along corresponding long edges of the two surfaces.

The platform may be mounted upon a stand, and this stand may incorporate one or more storage areas in which a pharmacist might keep supplies of blister strips, labels and other accessories used to assemble a complete package.

When a package is assembled using a packaging element of the invention it is desirable that an even firm pressure should be applied to the folded lamina to ensure a good bond is formed between the supporting member, the backing member and the blister strips. The preferred adhesive described hereinbefore requires only manual pressure to achieve an adequate bond, but it may in some circumstances be convenient to employ a roller, and preferably a rubber-faced roller to apply pressure. For example, the platform may be provided with an integral roller device comprising one or more rubber-faced rollers rotatably mounted by a carrier on a supporting bar extending alongside the bearing side with the rotational axis or axes normal to the support bar, the carrier being capable both of pivotting about the bar and of sliding along it so that the carrier may be hinged into a position where the or each roller contacts a packaging element located on the bearing surface and then the carrier may be slid along the supporting bar to pass the rollers over the packaging element. The roller or each roller is preferably dimensioned to extend substantially completely across the bearing surface transverse to the supporting bar when hinged into the rolling position. The entire bearing surface may then be swept in a single rolling action by sliding the carrier along the supporting bar. The carrier is preferably provided with a manually-grippable handle to enable it to be manipulated more easily.

The invention also extends to an assembled package containing a course of medication, which comprises a plurality of blister strips mounted on the supporting member of a lamina as defined hereinbefore so that the blisters of those strips form a matrix with the medication for one day of the course contained within the blisters of one row of the matrix, the lamina being folded to bond the one faces of the supporting member and the backing member to each other and sandwich the blister strips therebetween, and the outer face of the supporting member bearing directions in relation to each row of the matrix as to the day of administration of the contents of blisters in the row, and directions in relation to each column of the matrix as to the time of administration of the contents of blisters in the column.

Preferably the lamina in the package of the invention is obtained by removing the release sheet from a packaging element as described hereinbefore. A preferred completed package contains a one week course of medication arranged as a seven-row matrix.

The invention further extends to a process for preparing a package, in which the release sheet is removed from the packaging element of the invention, a plurality of blister strips containing a course of medication are mounted on the supporting member thereof so that the blisters form a matrix in which each row contains the medication for one day of the course arranged in chronological order of the time of administration, the backing member is folded to bond its one face to the one face of the supporting member and the mounted blister strips, and directions for administration are applied to the outer face of the supporting member so that each row is identified with a day of administration and each column is identified with a time of administration.

The assembled package of the invention is quite large, and will normally be too large for it to be carried in a pocket. For geriatric patients the size is a positive advantage since it makes the package conspicuous and it is less likely that the patient will forget to take the prescribed medication. However, for more active patients it is desirable that the overall size of the package should be reduced to make it easier to transport. Thus, the completed package may be adapted to be readily foldable along one or more fold lines. This may be achieved by providing a scored or weakened portion in the lamina of the packaging element along these fold lines. Alternatively, it is envisaged that the patient may want to cut the assembled package into more convenient strips comprising one or more rows of the matrix of blisters. Again this may be facilitated by providing one or more weakened lines on the lamina.

The blister strips used in the package of the invention may be of conventional construction. However, where the contents of the blisters are small it is normal to reduce the size of the blisters accordingly, so as to reduce the freedom of movement of the contents. As explained hereinbefore if the blisters are much smaller than the apertures in the supporting member of the packaging element the blisters will not be positively located in those apertures. It is therefore desirable that the blister strips are provided with some means of achieving a positive location. This may be achieved by forming at least the terminal blisters of a blister strip with a pair of radial projecting spurs to give the blister a greater effective width, when measured across the spurs. The spurs are preferably formed at diametrically-opposed portions of the blister wall. If desired all the blisters in a blister strip may be formed in this way.

With very small tablets or pills a blister sufficiently small to reduce unwanted movement is difficult to distort sufficiently to force the tablet or pill through the membrane. Thus, enfeebled patients may experience great difficulty in extracting the contents from such small blisters. To overcome this problem, and also provide a means of achieving positive location of the blister in a packaging element of the invention, the blisters are preferably formed with a stepped sidewall so that the blind end of the blister is of smaller diameter than an annular shoulder formed by the stepped sidewall. The smaller diameter portion acts as the pill-receiving pocket while the shoulder acts to locate the blister in a desired aperture and to reduce the effort required to remove the contents. An alternative means of facilitating removal of the contents of small blisters is to employ a material in the construction of the blister that is more readily deformable.

A further variation in the construction of blister strips, already mentioned hereinbefore which facilitates location of strips having small blisters is to stagger the blisters either side of the long axis of the strip, preferably alternately one either side of the axis. If the transverse distance between extremities of the blisters on a strip is substantially the same as the width of the apertures in the supporting member a positive location can be achieved.

The invention will now be described, though only by way of illustration, with reference to the accompanying drawings, in which:-

FIG. 7 is a general perspective view of a blister strip for use in the invention;

FIG. 8 is a general perspective view of a blister strip for use in the invention;

FIG. 9 is a general perspective view of a blister strip for use in the invention; and FIG. 10 is a general perspective view of a blister strip containing capsules for use in the invention.

Figure 1:
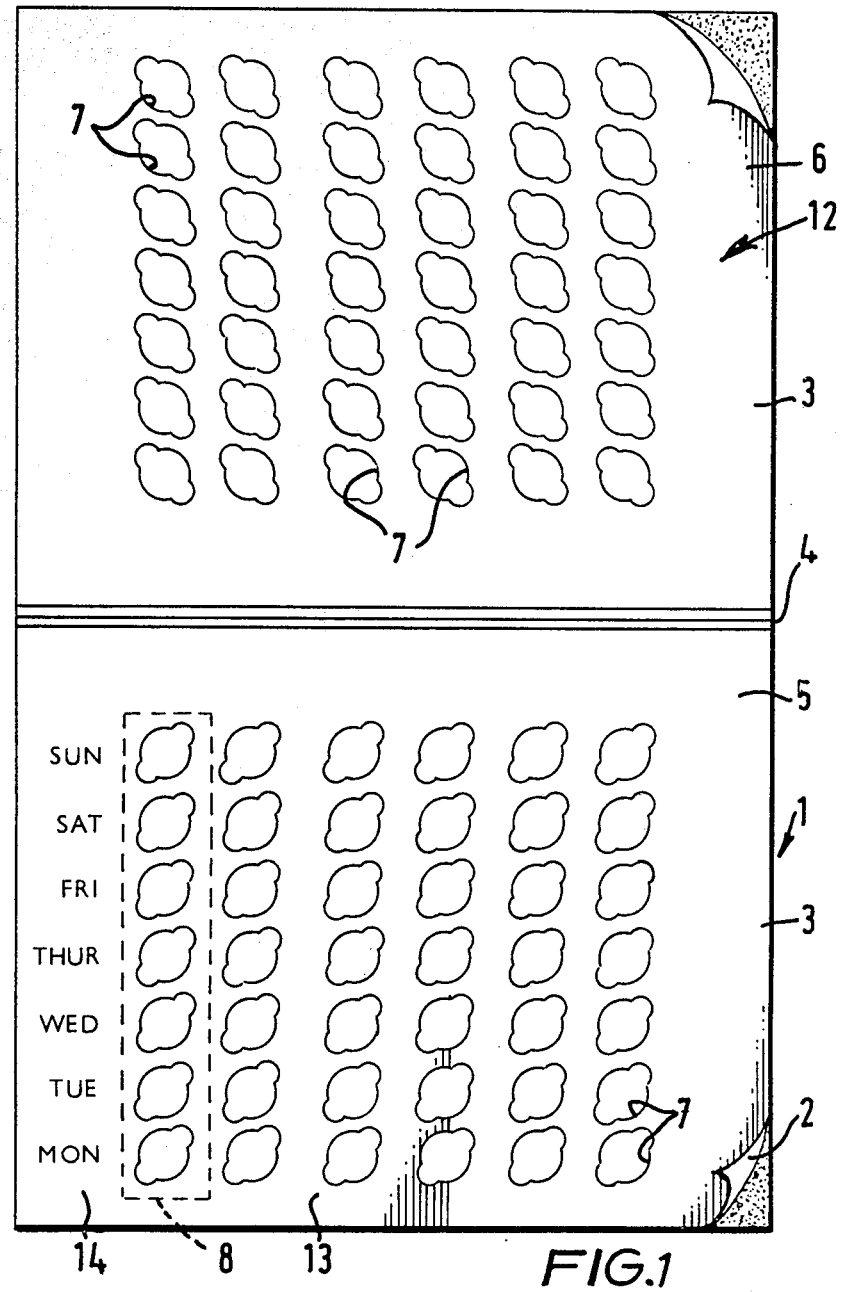
FIG. 1 is a view of the adhesive-bearing face of an element of the invention.
Figure 2:
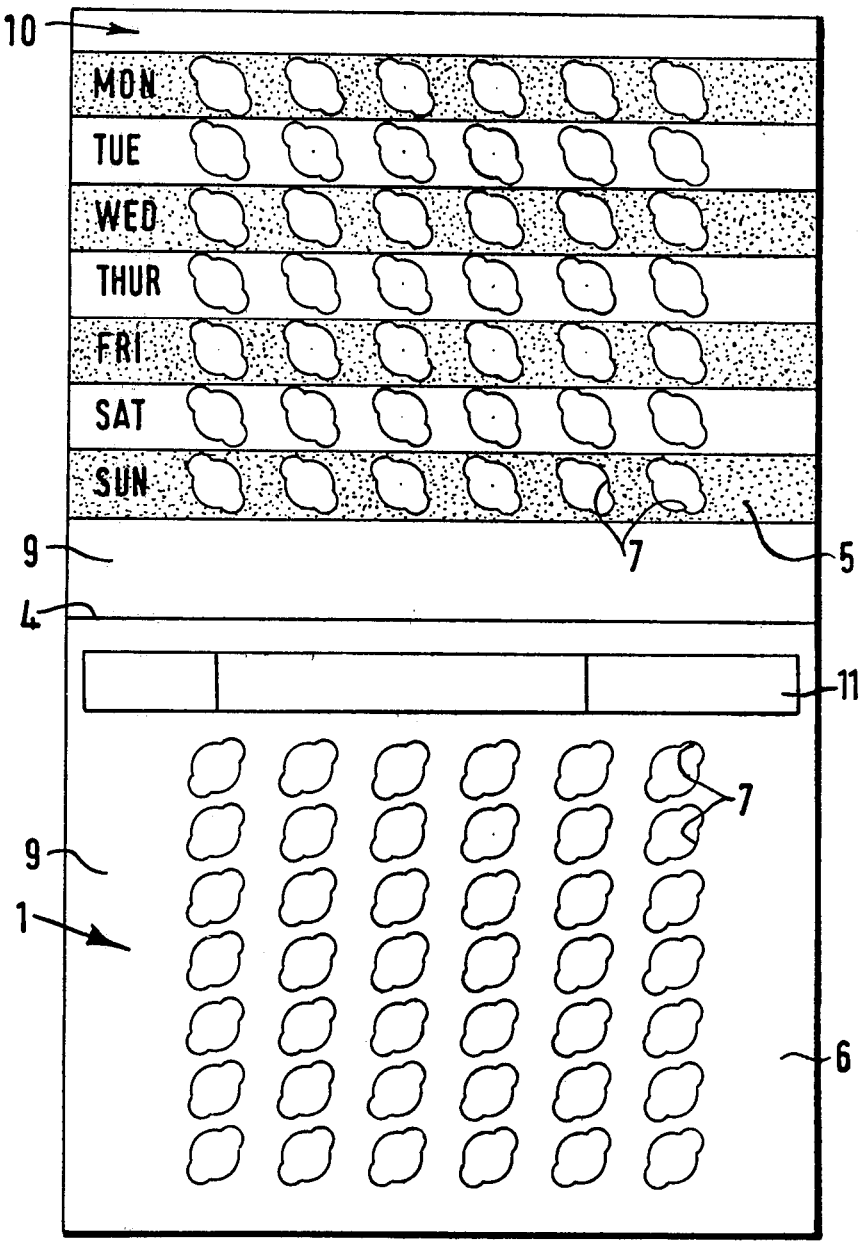
FIG. 2 is a view of the other face of the element of FIG. 1.

The element shown in FIGS. 1 and 2 comprises a lamina 1 having two silicone release sheets 2 strippably adhered to its one face 3, the sheets 2 being shown partially peeled back in FIG. 1. The lamina 1 is divided into a supporting member 5 and a backing member 6 by the fold line 4, which enables the lamina to be folded to bring the two portions of the face 3 into contact. This face bears a pressure-sensitive adhesive capable of bonding the members together and securing blister strips to the members.

Each member 5, 6 is provided with a plurality of apertures 7 which are in the form of four-cusped ellipses or quatrefoils. These apertures define a matrix and into them the blisters of blister strips may be mounted. FIG. 1 shows in dotted outline 8 the orientation of a mounted septuple blister strip.

The other face 9 of the lamina 1, the outer face when it is folded, is marked to show the day of administration for the contents of each row. The face 9 is adapted to receive directions for the time of administration in relation to each column at the points 10. This face 9 has a surface finish to facilitate the application of these directions, which may be applied by suitable rubber stamps, by handwriting or in the form of self-adhesive labels. There is also provision for inserting further information in the printed boxes 11 on the outer face of the backing member.

Figure 3:
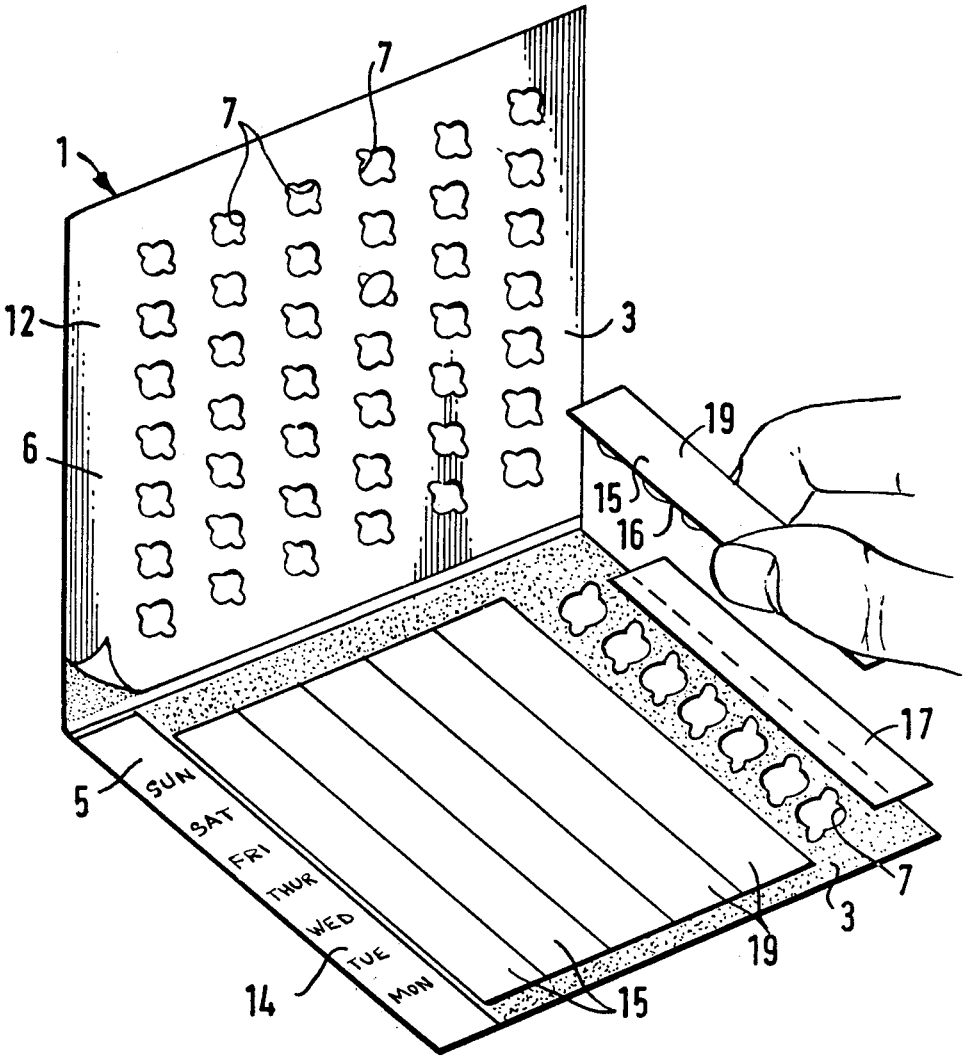
FIG. 3 is a general perspective view of a package of the invention being assembled.

The release sheets 2 respectively cover the one face of the backing member 6 and the one face of the supporting member 5. To assemble the element into a package, the release sheet covering supporting member 5 is removed and, as shown in FIG. 3, septuple blister strips 15 are mounted on the supporting member 5. The strips 15 each have seven blisters 16 containing a dose of a drug. The strips 15 are mounted so each day's medication occupies a row in the matrix of blisters arranged left to right in the order in which they are to be administered. The marginal portion 14 of the release sheet covering the supporting member 5 carries instructions for assembly including the day of administration for each row corresponding to the directions on the outer face 9.

When the complete week's medication is mounted the remaining release sheet 2 is removed, and the lamina 1 is folded to sandwich the blister strips 15 between the adhesive-bearing faces of the members 5, 6.

If there is insufficient space available on one lamina to mount all the strips 15, a second lamina may be used to mount the remainder. This is desirably joined to the first lamina by sandwiching a sheet 17 between the members 5, 6 of the laminas to join the two laminas edge to edge with their matrix rows aligned.

Figure 4:
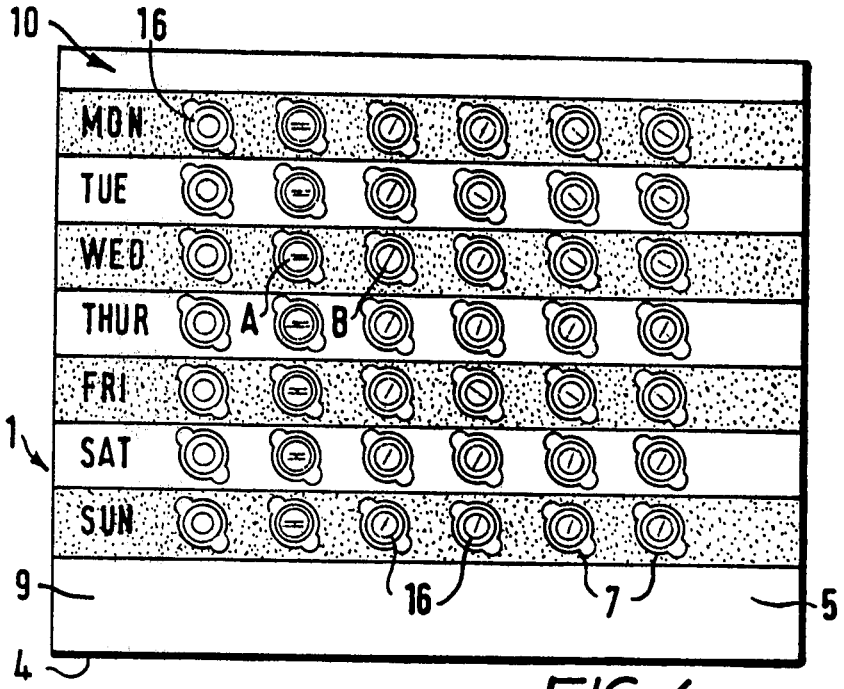
FIG. 4 is a front view of the assembled package shown being assembled in FIG. 3.
Figure 5:
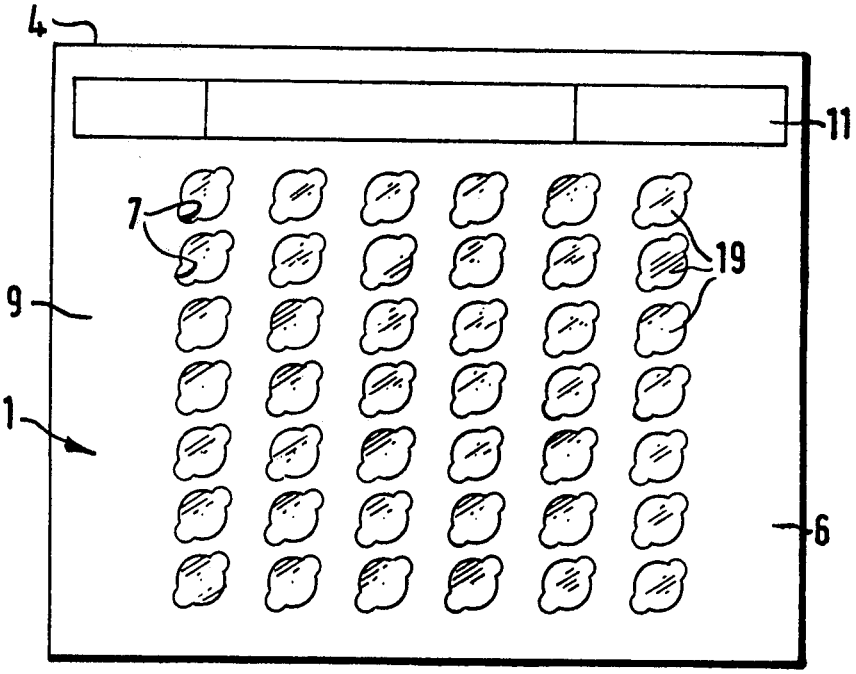
FIG. 5 is a rear view of the package of FIG. 4.

The complete package is shown in FIGS. 4 and 5 from each side. On the supporting member 5 labels may be applied at the heads of the columns of the matrix to show the time of administration for each column. When a dose is to be taken the contents in the blister 14 of the correct row and correct column are pressed through the foil seal 19 on the blister strip 15. For example, at noon on Wednesday the contents of blisters A and B could be designated for administration.

Figure 6:
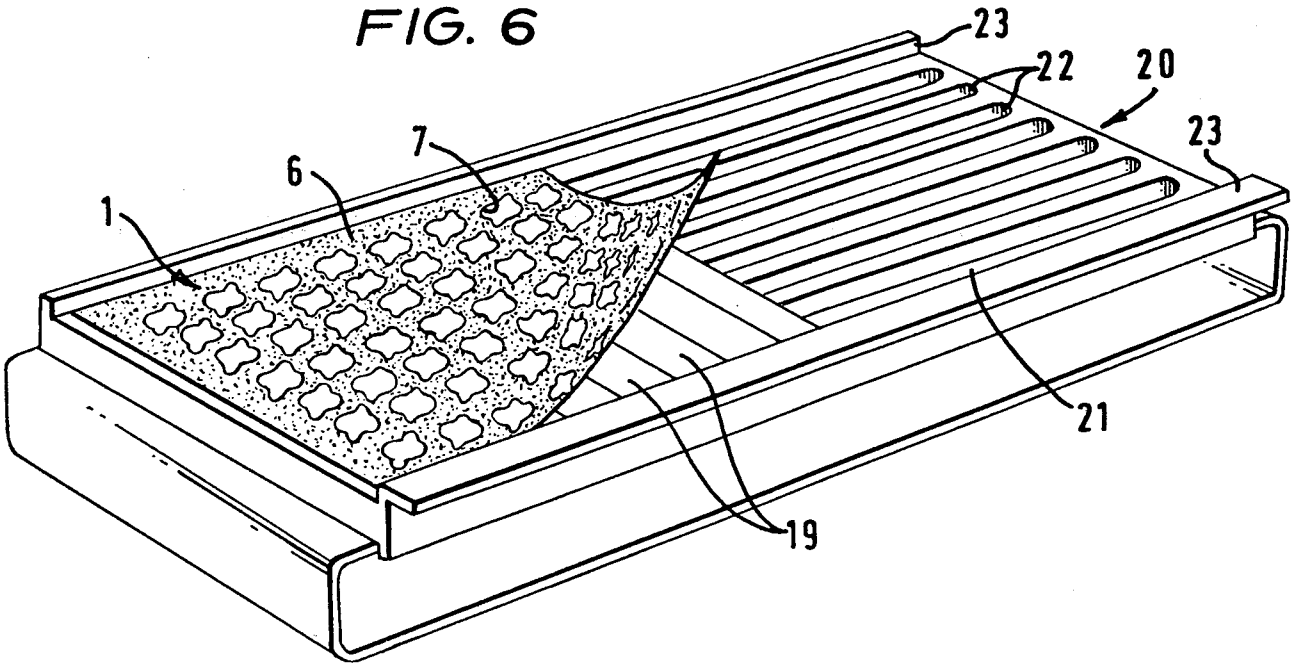
FIG. 6 is a general perspective view of a platform for use in assembling packages of the invention.

FIG. 6 shows a platform for use in assembling a package of the invention. A lamina is placed on the platform 20 with the supporting member 5 lying on the bearing surface 21 so that the holes coincide with slots 22. The bearing surface 21 supports the lamina yet allows the blister strips 15 to be inserted without hindrance. Upstanding walls 23 grip the edges of the lamina supported on the bearing surface 21. When the strips 15 are all mounted the lamina 1 is folded, and pressure is applied to ensure that the members 5, 6 and strips 15 are bonded together. When the package is bonded together, the lamina is turned over so that directions for administration can be applied, by means of a rubber stamp, handwriting or self-adhesive labels. The platform 20 may be provided with storage space below the bearing surface 21.

The blister strips used in connection with the embodiment of the element of the invention shown in FIGS. 1 to 6 are in the form of strips made up of seven blisters, although if therapy was to be discontinuous strips having fewer blisters could be employed. The blister strips may be conventionally constructed with blisters equally spaced on an elongate rectangular flange, the mouths of the blisters being sealed by a corresponding rectangular frangible membrane. The dimensions of the blister strips must be compatible with the element of the invention, and preferred dimensions for both these components are discussed hereinbefore. It is most convenient for the strips to be manufactured in the form of a rectangular blister sheet comprising a regular array of blisters made up of a plurality of septuple blister strips. Preferably the sheet is perforated between adjacent strips so that it may easily be separated into individual strips for making up into a package of the invention. If strips with fewer blisters are required, they can simply be cut to the appropriate length.

The flange and blisters are generally thermoformed from a suitable plastics film such as rigid PVC or PVDC-coated PVC, a particularly suitable film being from 200 to 300$\mu$ thick and most preferably 250$\mu$ thick.

The frangible membrane is conveniently an aluminium foil, and is preferably from 15 to 25μ thick, and most preferably 20μ thick.

As indicated hereinbefore where the pharmaceutical preparation is small it is convenient for the blister to be small as well, and it is desirable for at least the terminal blisters on a strip of such blisters to be provided with radial spurs so that the width of the blister across the extremity of the spurs is sufficient to give positive location of the blister within an aperture of the supporting member. A spurred blister strip is shown in FIG. 7.

The strip comprises a flange 31 having seven small blisters 32, the terminal blisters each having diametrically opposed radial spurs 33. The pharmaceutical preparations, shown as pills 34, sit within the blisters 32 without being able to move about therein to such an extent as would case damage. The spurs 33 do not project from the flange to the extent of blisters 32, but give a positive location within apertures in an element of the invention designed for use with larger blisters.

An alternative form of blister strip, shown in FIG. 8, is particularly suited to house very small tablets and pills, which might otherwise be difficult to dispense because of the strength of the blisters. The strip again comprises a flange 31 having seven blisters 32, but each blister has a stepped sidewall so that the blind end of each blister is of smaller diameter, forming a tablet-containing pocket 35 surrounded by a shoulder 36. The shoulder ensures positive location in an element of the invention while making it easier to force the contents 34 through the sealing membrane.

FIG. 9 shows a blister strip having staggered blisters. The seven blisters 32 are formed in flange 31 so that they lie either side of the long axis of the flange.

FIG. 10 shows a blister strip containing capsules. The strip again comprises a flange 31 having seven blisters 32 formed therein. However, each blister contains a capsule and is formed in an elongate shape corresponding to the capsule. The long axes of the blisters are parallel and at an angle of approximately 49° to the long axis of the strip.

The following Test Methods are now given, by way of illustration only, to show preferred methods of measuring peel adhesion and shear resistance of pressure-sensitive adhesives under consideration for use in the invention.

TEST METHOD 1: IMMEDIATE 180° PEEL ADHESION—MODIFIED F.I.N.A.T. SPECIFICATION NO. 1

The test is carried out on a tensile tester, or similar machine, capable of giving tensile load readings accurate to ±2% with a jaw separation rate of 20 cm (200 mm) per minute.

The adhesive under test is coated on to one side of a backing sheet formed of a suitable paper or polyester sheet, and may be protected by a suitable release sheet applied to the adhesive. Before carrying out the test a test strip 5 cm wide and at least 17.5 cm long is prepared from the adhesive-coated sheet and conditioned at 23° C.±2° C. and 50%±2% relative humidity for at least 4 hours. After this conditioning the release sheet is removed and the adhesive-coated backing sheet is adhered to a stainless steel test plate, previously polished with 180 grit abrasive paper and thoroughly cleaned. Using a roller covered in rubber of 50/55 British Standard degrees, of hardness, 3.2 cm wide and 2000 g in weight, the test strip is rolled four times at a speed of 60 cm±5 cm per minute to ensure an intimate bond between the test strip and the test plate.

The test plate is then mounted on the tensile tester so that the test strip is peeled back through 180° along the length of the test strip (that is, normal to the 5 cm width) at a rate of 20 cm/minute.

10 readings of the tensile force in grammes required to peel the test strip are taken, one reading being taken every 0.5 cm from the center of the test strip. The average of these readings is the adhesive force per 5 cm width under the test conditions employed.

Where the adhesive force exceeds the strength of the backing material, the result quoted shall be the maximum reached before the paper tears and this result shall be followed by the postscript P.T. If adhesive transfer occurs, this shall be indicated by the letters A.T.

Between tests the test plates must be thoroughly cleaned so that no trace of adhesive, grease, silicone or moisture is left on the surface. The recommended method is to reflux the plates in sulphur-free toluene but other methods which remove contamination properly can be adopted. After cleaning, the plates shall be left for 30 minutes under standard test conditions.

TEST METHOD 2: SHEAR RESISTANCE—F.I.N.A.T. SPECIFICATION NO. 8

The test apparatus comprises a rigid horizontal bar from which test specimens may be suspended.

The test specimens are prepared by cutting strips 20 mm wide from a backing sheet coated on one side with the pressure-sensitive adhesive under test the adhesive being protected by a release sheet applied thereto. The specimens are conditioned for at least 4 hours under the test conditions of 23° C.±2° C. and 50%±2% relative humidity.

After conditioning, the backing paper of two strips are removed and the strips joined adhesive to adhesive with an overlap area of 20 mm×20 mm. The joined strips are placed between release coated paper and rolled once with the standard test roller described in Test Method 1 at a speed of 150 mm±12.5 mm per minute to obtain intimate contact between the two adhesive surfaces. The joined strips are then suspended vertically from the horizontal bar and a 1000 gramme weight is attached to the free end of the test strip. The weight shall be attached to the strip not less than 5 minutes and not more than 10 minutes after rolling the sample.

As explained hereinbefore the time taken for the strips to shear apart is taken as a measure of shear resistance. At least three tests are run and the average of the results is the shear resistance value for the tested adhesive.

Finally, the following Evaluations are given, although again only by way of illustration, to show the performance characteristics of a preferred embodiment of the invention.

Evaluation 1: Peel Adhesion Characteristics

A backing sheet was coated with Norprint R&D663 adhesive (a pressure-sensitive adhesive incorporating a styrene-butadiene rubber as base polymer) at 25 gsm, and the coated backing sheet was then cut into test strips that were tested for immediate 180° peel adhesion according to the method described in Test Method 1 set out hereinbefore.

The immediate 180° peel adhesion measured in this way was significantly greater than 1000 g/50 mm under the conditions defined in Test Method 1.

Evaluation 2: Shear Resistance

Further test strips were cut from the adhesive-coated backing sheet prepared in Evaluation 1. The test strips were prepared and tested according to the method detailed in Test Method 2 to determine the shear resistance of the adhesive.

The shear resistance was found to be significantly in excess of 12 hours under the conditions specified in Test Method 2.

Evaluation 3: Long Term Storage

This Evaluation was performed to assess the ability of the Norprint R&D663 adhesive to withstand storage under a variety of conditions of temperature and relative humidity without undesirable degradation in its properties. In particular, the Evaluation investigated the ability of the adhesive to resist "stress lifting" under the test conditions.

A packaging element of the invention was prepared by applying Norprint R&D663 adhesive to the one side of a white manilla cardboard lamina of nominal 0.30 mm thickness. The lamina comprised two rectangular portions—a supporting member and a backing member—each 175 mm×160 mm and each punched with a six-column seven-row matrix of holes 15 mm in diameter. The supporting member and the backing member are joined along a common edge which is a fold-line produced by scoring the lamina. A silicone release sheet was applied to the adhesive-coated face of the lamina.

A number of packaging elements prepared in this manner were assembled to form integral packages by mounting septuple blister strips therein. The assembly of a package was effected by removing the release sheet from a packaging element and mounting six septuple blister strips of appropriate dimensions within the holes of the supporting member from the adhesive-coated side. The blister strips were mounted one to each column respectively of the matrix of holes in the supporting member. The lamina was then folded to bring the adhesive-coated faces of the supporting member and the backing member together sandwiching the mounted blister strips therebetween. An even firm pressure was applied to the folded lamina to ensure maximum bonding between the two members and the blister strips.

The assembled packages were then assessed by exposing them to various conditions of temperature and relative humidity. The conditions employed were as follows:

(a) Cold storage at 4° C.;
(b) Storage at room temperature and humidity; and
(c) Storage at 37° C. and 80% relative humidity.

A set of three packages was subjected to each set of conditions, respectively. The tests were carried out over a continuous 25 day exposure to the temperature and humidity conditions after which the packages were examined.

The performance of the packages was evaluated by examining the extent to which the adhesive bond between the two halves of the lamina and the blister strips had broken down and rating this on a scale of 0 to 10.

10=no adhesive breakdown, bond maintained over 100% of package area;
9=10% of package area where adhesive bond broken;
8=20% adhesive breakdown
7=30% adhesive breakdown
6=40% adhesive breakdown
5=50% adhesive breakdown
4=60% adhesive breakdown
3=70% adhesive breakdown
2=80% adhesive breakdown
1=90% adhesive breakdown
0=Complete absence of adhesive bond between the two halves of the lamina and the blister strips.

The results obtained are set out in the Table below.

| Storage Test Results | | | | |
|---|---|---|---|---|
| Conditions | Rating | | | Ave |
| (a) 4° C. | 10 | 10 | 10 | 10 |
| (b) Room temprature and humidity | 10 | 10 | 10 | 10 |
| (c) 37° C. + 80% R.H. | 10 | 8 | 8 | 9 |

These results show that the adhesive tested had a remarkable resistance to failure by stress lifting. This is so even at conditions of high temperature and high humidity which are more extreme than a package of the invention would normally be expected to endure, at least as regards use in Britain. The results are particularly remarkable when compared to the performance of other adhesives which do not satisfy the requirements for the adhesive used in the invention; a typical result for such an adhesive when subjected to 37° C. and 80% relative humidity would be in the region of 1–3.

The adhesive tested showed itself to be compatible with all the materials of the lamina and the blister strip with which it was placed in contact, whle providing a high degree of bonding between these components even under adverse conditions.

Evaluation 4: Short-term Localised Stress

For each of the testing conditions investigated in Evaluation 3, a package was taken and at room temperature and humidity the use of the package by a patient was simulated by depressing each blister in the package in turn. This was done, without any special precautions to avoid distortion of the package, simply by the tester holding the package wih one hand and crushing the blisters in turn with the thumb of this other hand until the sealing membrane ruptured. After crushing each blister the integrity of each package was reevaluated using the scale of 0 to 10 defined in Evaluation 3.

The results are set out in the Table below.

| Short-term Stress Test Results | | |
|---|---|---|
| Package | Before crushing blisters | After crushing blisters |
| (a) | 10 | 10 |
| (b) | 10 | 10 |
| (c) | 8 | 9 |

It will be noted that not only did none of the packages lose integrity or suffer any degradation in the adhesive bond during the simulated use, but the package rated at 8 before the blisters were crushed was rated higher after the crushing of the blisters. The simulated use did not show up any weakness in the assembled package, but underlined the highly advantageous nature of the invention in that an incompletely bonded package performed excellently with no tendency for the blister strips to become dismounted or displaced from the package. This indicates the ability of packages assembled from packaging elements of the invention to present a course of medication in a form which will encourage patient compliance while being sturdy enough to withstand both prolonged storage under adverse conditions and careless handling.

I claim

1. A packaging element for mounting blister strips containing a course of medication for a patient, which element comprises a lamina foldable along a straight line dividing the lamina into a supporting member and a backing member so that when the lamina is folded the one faces of the members lie adjacent, characterised in that the supporting member is provided with a plurality of apertures for receiving the blisters of a plurality of prepackaged blister strips when the blister strips are mounted on the one face of the supporting member so that the blisters project through the member and form a matrix in which the blister strips are aligned with the columns of the matrix, each of said blister strips containing a single regimen of medicine and being sealed with a frangible membrane, the backing member being provided with a plurality of apertures arranged so that when blister strips are mounted on the supporting member and the lamina is folded the contents of the blisters may be removed through the backing member, the one faces of the members bearing a compatible pressure-sensitive adhesive capable of securing blister strips to the two members and of bonding together the one faces of the two members, the other face of the supporting member bearing or being adapted to receive in relation to each row of the matrix directions as to the day on which the contents of the blisters in the row are to be administered and further being adapted to receive directions in relation to each column of the matrix as to the time of each day for administration of the contents of blisters in the column, the element further characterised in that it comprises one or more protective release sheets strippably adhered to the pressure-sensitive adhesive.

2. An element as claimed in claim 1, characterised in that the supporting member is provided with apertures capable of receiving blister strips so that the blisters form a seven-row matrix, and the backing member is provided with corresponding apertures to allow the contents of blister strips so mounted to be removed.

3. An element as claimed in claim 1 or claim 2 characterised in that the lamina is symmetrical about the fold line so that the outer edges of the two members correspond when the lamina is folded.

4. An element as claimed in claim 3 characterised in that the lamina is rectangular with the fold line parallel to and equidistant between two opposed sides of the rectangle.

5. An element as claimed in claim 4 characterised in that the lamina has a thickness of from 0.20 to 0.46 mm.

6. An element as claimed in claim 5 wherein the lamina has a thickness of from 0.28 to 0.38 mm.

7. An element as claimed in claim 1 characterised in that the apertures in each member are a series of holes in the shape of a fourcusped ellipse.

8. An element as claimed in claim 7 characterised in that the spacing between the centres of the holes in each column of the matrix is 20 mm.

9. An element as claimed in claim 8 characterised in that the diameter of the holes in the supporting member is from 14 to 17 mm.

10. An element as claimed in any one of claims 7 or 8 or 9 characterised in that the spacing between adjacent apertures in the same row is from 22 to 24 mm between centres.

11. An element as claimed in claim 1 characterised in that the pressure-sensitive adhesive has a minimum immediate 180° peel adhesion of 1000 grams/50 mm from a stainless steel plate having 180 grit finish at a peeling speed of 200 mm/min., a temperature of 23° C.±2° C. and a relative humidity of 50%±2%.

12. An element as claimed in claim 1 characterised in that the pressure-sensitive adhesive has a minimum shear resistance of 12 hours for a 20 mm×20 mm overlap between adhesive-coated samples applied face to face to which is applied a shear load of 1000 grams at 23° C.±2° C. and 50%±2% relative humidity.

13. An element as claimed in claim 1 characterised in that the pressure-sensitive adhesive employs a styrene-butadiene rubber as the base polymer.

14. An element as claimed in claim 1 characterised in that the other face of the supporting member bears printed matter identifying the day on which the contents of each row of the matrix are to be administered.

15. An element as claimed in claim 14 characterised in that a release sheet bears printed matter identifying the day on which the contents of each row of the matrix are to be administered.

16. An element as claimed in claim 1 characterised in that the other face of the supporting member is marked so as to define seven visible stripes which extend thereacross, each stripe corresponding to and being associated with the apertures for receiving the blisters of one row of the matrix.

17. A package containing a one week course of medication for a patient characterised in that it comprises a plurality of prepackaged blister strips mounted on the supporting member of a lamina as defined in claim 1 so that the blisters of those strips form a matrix with the medication for one day of the course contained within the blisters of one row of the matrix, the lamina being folded to bond the one faces of the supporting member and the backing member to each other and sandwich the blister strips therebetween, and the outer face of the supporting member bearing directions in relation to each row of the matrix as to the day of administration of the contents of blisters in the row, and directions in relation to each column of the matrix as to the time of each day for administration of the contents of blisters in the column.

18. A blister strip in which the blisters are staggered alternately on either side of the long axis of the strip.

* * * * *

UNITED STATES PATENT AND TRADEMARK OFFICE

CERTIFICATE OF CORRECTION

PATENT NO. : 4,254,871

DATED : March 10, 1981

INVENTOR(S) : ALBERT C. G. POORE

It is certified that error appears in the above-identified patent and that said Letters Patent are hereby corrected as shown below:

Column 6, line 46, change ",esirable" to --desirable--.

Column 14, line 18, before "laminas" (first occurrence) insert --two--.

Column 15, line 17, change "case" to --cause--.

Signed and Sealed this

*Twenty-second* Day of *February 1983*

[SEAL]

*Attest:*

GERALD J. MOSSINGHOFF

*Attesting Officer*

*Commissioner of Patents and Trademarks*